US006431071B1

(12) United States Patent
Hodge et al.

(10) Patent No.: US 6,431,071 B1
(45) Date of Patent: Aug. 13, 2002

(54) MEMS ARM FIRE AND SAFE AND ARM DEVICES

(75) Inventors: Kathleen F. Hodge, North Hollywood; David H. Lewis, Jr., Irvine; Steven D. Nelson, Redondo Beach, all of CA (US); Victor W. Ruwe, Hartselle, AL (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/665,230

(22) Filed: Sep. 18, 2000

(51) Int. Cl.[7] ..... F42C 15/26; F42C 15/00

(52) U.S. Cl. ..... 102/254; 102/231; 102/256; 102/262; 102/254; 102/221; 102/222

(58) Field of Search ..... 102/231, 256, 102/235, 221, 222, 247, 262, 254, 244, 229

(56) References Cited

U.S. PATENT DOCUMENTS

| | | | | | |
|---|---|---|---|---|---|
| 4,815,381 | A | * | 3/1989 | Bullard | 102/247 |
| 4,986,184 | A | * | 1/1991 | Kude | 102/256 |
| 5,705,767 | A | * | 1/1998 | Robinson | 102/231 |
| 6,167,809 | B1 | * | 1/2001 | Robinson et al. | 102/235 |

FOREIGN PATENT DOCUMENTS

| | | | | |
|---|---|---|---|---|
| NL | DT 3524080 | * | 1/1987 | 102/221 |
| SE | WO 82/01244 | * | 4/1982 | 102/235 |

* cited by examiner

*Primary Examiner*—Charles T. Jordan
*Assistant Examiner*—Lulit Semunegus
(74) *Attorney, Agent, or Firm*—Ronald M. Goldman

(57) ABSTRACT

Miniature arm fire and safe and arm devices include an electrically operated pyrotechnic initiation device (5) to generate a detonation wave upon command and a movable pressure barrier (9) that blocks propagation of the detonation wave if the device is not intended to be fired and opens a window (12) to transfer the detonation wave externally of the device. The detonation wave may in alternate embodiments be a subsonic flame front and pressure wave or a supersonic shock wave, respectively. An electromagnet (7) may serve to move the pressure barrier. Detonation waves output from the device have application in igniting an explosive train, either directly or indirectly, the latter by operating an electrical switch. In the arm fire device, the barrier automatically prevents a detonation output when electrical power is removed from the device. In the safe and arm device, the barrier, once moved out of the way, remains out of the way, even when electrical power is removed. Various forms of miniature single operate electrical switches are described that may be operated by the foregoing devices.

15 Claims, 3 Drawing Sheets

MEMS ARM FIRE AND SAFE AND ARM DEVICES

CROSS-REFERENCE TO RELATED APPLICATIONS

Reference is made to the copending, commonly assigned U.S. patent application, Ser. No. 08/912,709, filed Aug. 18, 1997 entitled Integrated Pulsed Propulsion and Structural Support System for Micro-satellite, the disclosure of which is incorporated herein by reference.

FIELD OF THE INVENTION

This invention relates to micro-electromechanical systems ("MEMS") and, more particularly, to micro-miniaturization of electrical switches and arming and firing devices having application in missiles, rockets, and like apparatus.

BACKGROUND

In order to prevent a rocket motor, warhead, explosive separation device or energetic material, collectively sometimes referred to as target devices, from being unintentionally operated during flight or in any circumstance that could produce an extreme hazard to personnel or facilities, an "arm fire" device is customarily incorporated in the firing control circuit for the foregoing devices as a safety measure. The arm fire device electrically and mechanically interrupts the "ignition train" to the target device so as to prevent accidental operation. The arm fire device includes a mechanism that permits the target device to be armed, ready to fire, only while electrical power is being applied to the target device. When that electrical power is removed, signifying the target device is disarmed, the mechanism of the arm fire device returns to a safe position, interrupting the path of the ignition train.

Another known device of similar purpose, is called the "safe and arm" device, and is a variation of the arm fire device. The mechanism of the safe and arm device enables the target device, such as the rocket motor, warhead and the like, earlier mentioned, to remain armed, even after electrical power is removed. The device may be returned to a "safe" position only by applying (or reapplying) electrical power. The safe and arm device is commonly used to initiate a system destruct in the event of a test failure, for launch vehicle separation and for rocket motor stage separation during flight. Typically, the safe and arm device uses a pyrotechnic output which may be either a subsonic pressure wave or which may be a flame front and supersonic shock wave or detonation to transfer energy to another pyrotechnic device (and serves as the trigger of the latter device).

The foregoing safety devices have been proven in service. Constructed using existing technology, those safety devices are typically of the size of a person's fist, and possess a noticeable weight of several pounds. If the weight and volume of those devices can be reduced, the payload and propulsion systems can be increased in weight and/or volume to increase the range and capability of a weapon system. Given the goal of reducing weight and volume, the arm fire device and the safe and arm device are candidates for significant miniaturization in the system. As an advantage the present invention addresses the function of arm fire devices and safe and arm devices, and accomplishes the functions of the foregoing devices in an electromechanical apparatus that is significantly smaller in size and weight than the presently existing counterparts.

Micro-electromechanical systems ("MEMS") have become known to a degree. The MEMS devices reported in the literature represents an achievement milestone in miniaturization and integration of electromechanical machines and devices. That technology provides, as example, a toothed gear that is smaller in size than a speck of dust, invisible to the eye. MEMS devices are sometimes fabricated by employing the photo-lithograph mask and etch techniques familiar to those in the semiconductor fabrication technology to form micro-miniature parts of silicon, which are annealed to strengthen the part. In copending application Ser. No. 08/912,709, a micro-miniature pyrotechnic gas generator, called a micro-thruster is described that is capable of issuing a microburst of gas in which the expelled gas is applied to produce thrust for a micro-satellite or other small craft.

Accordingly, a principal object of the invention is to micro-miniaturize arm fire and safe and arm devices.

Another object of the invention is to provide electrical single operation switch designs for fabrication using MEMS fabrication techniques.

An ancillary object of the invention is to produce micro-miniature single operate electrical switches.

SUMMARY OF THE INVENTION

Miniaturized light-weight arm fire and safe and arm devices are made possible by incorporating the advantages of micro-electromechanical system ("MEMS") technology in the devices. In accordance with the invention, arm fire and safe and arm devices include an electrically operated pyrotechnic initiator or, as variously termed, MEMS ignition device to generate a pyrotechnic output upon command and an electro-mechanically movable pyrotechnic barrier that blocks propagation of the shock wave and expanding gases of the pyrotechnic output if the device is not intended to be fired. The pyrotechnic output is transferred from the device for use in igniting an explosive train, either directly or indirectly, the latter, as example, by operating an electrical switch. To prevent output through unintended operation of the MEMS ignition device the pyrotechnic barrier is normally positioned to block the output; and the barrier is moved out of the way when output is desired. In the arm fire device, the barrier automatically prevents an output when electrical power is removed from the unit. In the safe and arm device, the barrier, once moved out of the way, remains out of the way, even when electrical power is removed.

As an additional feature, the switch operator of a micro-miniature electrical switch receives the pyrotechnic output and is moved in position by the pyrotechnic output to close a pair of normally open electrical contacts. The contacts may be included in an electrically operated explosive train.

An ancillary invention in a miniature single operation electrical switch includes an electrically operated MEMS gas generator, a movable switch operator and a pair of electrical contacts. On applying a current pulse, a microburst of hot gas is generated that forces the switch operator to shift in position to change the condition of a DC current path through the electrical contacts.

The foregoing and additional objects and advantages of the invention together with the structure characteristic thereof, which was only briefly summarized in the foregoing passages, will become more apparent to those skilled in the art upon reading the detailed description of a preferred embodiment of the invention, which follows in this specification, taken together with the illustrations thereof presented in the accompanying drawings.

DESCRIPTION OF THE PREFERRED EMBODIMENTS

Figure 1:
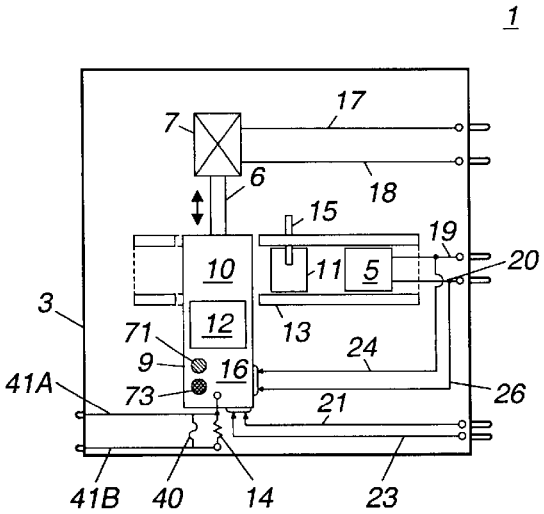
FIG. 1 is an embodiment of an arm fire device as the embodiment appears in the unarmed (or safe) mode.

FIG. 1 to which reference is a not-to-scale pictorial view of an embodiment of an arm fire device 1 constructed in accordance with the invention illustrating the device in a top plan view and in the unarmed (safe) position. The device includes a base 3, suitably of a conventional resin based printed circuit board, ceramic substrate or other substrate, and the various components attached to the top surface of base 3. Those components include a MEMS ignition device 5, electromagnet solenoid 7, and a multi-part mechanical slider assembly 9. That slider assembly includes a movable slider 10, a firing piston 11, a firing piston channel 13 and shear pin 15. The slider 10 is oriented perpendicular to the firing piston channel 13 for transverse movement. The slider contains an upper portion that is solid and serves as a barrier, a like bottom portion 16 and a window 12 between the two cited portions, as later more fully described herein. A tension spring 14 attaches to the remote end 16 of slider 10 and the armature 6 of solenoid 7 connects to the upper end of slider 10. Metal leads 17 and 18, plated on the base, electrically connect the terminals of electromagnet 7 to respective edge pins on an edge of the base 3. Likewise plated-on metal leads 19 and 20 electrically connect the terminals of the MEMS ignition device 5 to respective edge pins on the right edge of base 3.

A pair of contact pins mounted to base 3 connect via respective plated-on leads 21 and 23 to respective edge contacts on the base. The contact pins are positioned to contact a conductive metal end on slider 10, which serves as an electrical bridging contact, when the slider is in the safe position illustrated in the figure. Through the edge contacts, the circuit through the pin contacts connect to an indicator circuit, not illustrated, so that when the slider is in the safe position the circuit through leads 21 and 23 is closed and an indicator, such as a lamp, will illuminate indicating "safe", to the operator. As a mechanical indicator, the slider 10 may be painted with green 71 and red 73 colored patches, only one of which may be viewed through an indicator window in the cover, not illustrated, to the arm fire device. Normally the green patch is visible in the safe mode. When the unit is placed in the arm mode, later herein described, the red patch is then visible through the indicator window in lieu of the green patch. If a safe condition is not indicated for any reason, then personnel should investigate to determine the cause.

Further, leads 24 and 26 are connected to leads 19 and 20 that lead to the ignition device 5, and to respective contacts located on the side of the slider 10. The latter contacts are in contact with another electrical bridging contact on the lower side of slider 10, when the slider is in the unarmed mode, as illustrated in the figure. The bridging contact places a short-circuit across the electrical circuit to the MEMS ignition device 5 to prevent inadvertent electrical energization of that device as an added safeguard.

Packaged similar to the packing used for semiconductor chips, preferably the unit may be plugged into a standard integrated circuit chip socket to mount and connect the device to external control and power circuitry, not illustrated. Although the foregoing components are three-dimensional in geometry, the components are of a very short height in this miniature device. Hence, a side view of the components does not offer any details of particular note and, accordingly, need not be illustrated.

Firing piston channel 13 may be constructed of flat rectangular tubing that has a rectangular passage cut through the sides to provide the mounting for the slider assembly 9. Using a microscope the firing piston 11 is inserted into the channel and a passage in a side of that piston is aligned with a hole drilled or cut into the side of the rectangular tubing of the channel 13. The shear pin 15 is then inserted into place to hold firing piston 11 in place in the channel.

Slider 10 is rectangular in cross section and sufficient in size to fill the lateral passages in the firing piston channel but with sufficient clearance on the sides to move freely through that channel. If found necessary or desirable, guide rails may be included in the slider assembly 9 to guide slider 10 as it moves, as described herein, assuring that the slider does not bind.

Slider 10 may be formed of a metal or a magnetic metal material. The central section of the slider assembly contains an opening or passage 12 and another passage orthogonal thereto, not visible in the figure, that leads to the right and opens into channel 13. The window portion is bounded by four straight frame members, only two of which are visible in this top view, joining the upper portion of the slider to the lower section 16. The bottom surface of the slider underlying window 12 is closed by a panel, and the left vertical side of the slider adjacent window 12 is also closed by a panel, not illustrated.

On assembly of the device, the slider is pushed to the position illustrated with the upper barrier portion of slider 10 blocking firing channel 13. With the assistance of a microscope, the ends of spring 14 are hooked into holes, not illustrated, formed in the base 3 and in slider assembly 9, or may be soldered to those components. Preferably, a fusible link 40 is mechanically coupled across spring 14, such as by soldering, to normally restrain the spring, preventing the spring from expanding. The fusible link restrains slider 10 from changing in position at this stage, notwithstanding shock or vibration, as might occur when the arm fire device is being transported. Leads 41A and 41B extend the circuit from the link to contacts at the edge of base 3. That restraint is removed at the appropriate time by applying current over those leads to break the link.

The length of the upper portion of slider 10 is about equal to the distance to the front of electromagnet solenoid 7 so that when the slider is moved through the firing channel 13 to, as example, into abutment with the solenoid or the uppermost position of travel, as later herein described during operation, the right hand side window, not visible in the figure, that is perpendicular to window 12, is centrally positioned in the firing piston channel 13 and provides a clear passage through that channel into the slider 10, and, through a right hand turn, (upwardly from the plane of the drawing) through window 12.

The foregoing components may be fabricated to the requisite miniature size by any of the many available precision metal machine shops, particularly those firms having some experience with the MEMS technology or other miniaturized fabrication. The electromagnet 7 and firing piston channel 13, the latter supporting slider assembly 9, are attached to base 3, as example, with epoxy. MEMS ignition device 5 is also mounted at the end of the channel 13, through an end cut-out in that channel to base 3, suitably by epoxy.

MEMS ignition device 5 is preferably constructed as described in copending application Ser. No. 08/912,709, referred to earlier. In that structure a quantity of solid pyrotechnic material, such as lead styphenate or zirconium potassium perchlorate, is confined within millimeter (micro-miniature) sized cavity and the cavity is sealed by a wall. In other embodiments in which sub-sonic velocity of gas is desired, lead phtalate may be substituted. By design, that sealing wall is constructed to be weaker in strength than other walls in the cavity or contains a portion of that wall that is weakened. To complete the ignition unit, the cavity is mounted in thermal conductive relationship to an electrical resistance heater element associated therewith.

The MEMS ignition device produces a pyrotechnic output, typically a subsonic pressure wave or supersonic detonation wave, occurring, typically over an extremely short time interval of less or equal to one-thousand micro-seconds. A typical MEMS ignition device in size measures about 900 $\mu$m by 900 $\mu$m×1400 $\mu$m. When one desires the unit to provide a pyrotechnic output, electric current is applied to the heater. Within a millisecond or so, the heat generated couples into the cavity and ignites the confined pyrotechnic material, which instantaneously produces expanding hot gas and a shock wave sufficient in force to break through the weaker wall of the unit.

Figure 3:
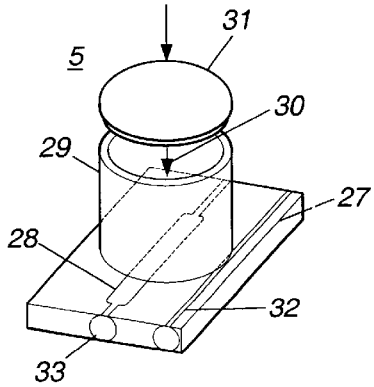
FIG. 3 illustrates in a partially exploded view a MEMS ignition device used in the embodiment of FIG. 1.

Such MEMS ignition devices can be provided in many different forms. As illustrated in FIG. 3, a suitable pyrotechnic device 5' may be fabricated on a substrate 27, such as a circuit board, ceramic layer or other conventional substrate material. A thermal resistive material 28 is deposited on the substrate, a small pot or cavity 29, about $1/16^{th}$ inch in diameter is attached by epoxy atop the resistive material, pyrotechnic ingredient 30 is inserted into the pot, and the weak-strength cover 31 is sealed in place closing the cavity. Electrical contacts 32 and 33 and the associated wiring on the circuit board or substrate permit electrical current to be applied to resistance heater 28. The foregoing pyrotechnic device may be positioned in the combination of FIG. 1, as 5, oriented so that the lid is in the channel facing the direction of firing piston 11.

Returning to FIG. 1, the operation of the device is next considered. In safe mode, which FIG. 1 illustrates, electromagnet solenoid 7 remains unenergized. The slider 10 is positioned blocking channel 13. Firing piston 11 is held in place by shear pin 15 and the electrical triggering circuit to MEMS ignition device 5 remains short circuited by the bridging contact at the side of the slider.

Should the MEMS ignition device 5 be fired inadvertently, as example, should an ill-trained technician rest a hot soldering iron on the ignition device, piston 11 will be forced forward to break shear pin 15. However, the lateral force is not great enough to force slider 10 out of channel 13 or otherwise remove that barrier. Thus the pyrotechnic blast cannot propagate through window 12. In the latter regard, it is noted that the side walls of the firing channel shown to the left in the figure adds further support to the side of the upper portion of slider 10, forming, so to speak, a flying buttress to prevent further lateral movement of the firing piston 11. The hot gas and pressure remains confined and cannot reach a "secondary ignitor", not illustrated, external of the arm fire device of the system in which the arm fire device is installed. Everything thus remains "safe".

Figure 2:
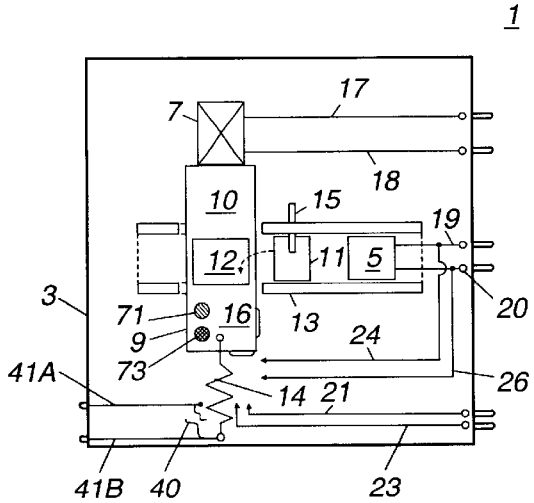
FIG. 2 shows the embodiment of FIG. 1 as the embodiment appears in the fire mode.

Once the arm fire device 1 has been transported and installed in a system, personnel apply electrical current to the fusible link 40 via leads 41A and 41B, and the current melts the link. That removes the restraint from spring 14. When one desires to arm a target device, the electromagnet solenoid 7 must be energized. By applying current to electromagnet 7 over leads 17 and 18, the device transitions into the "arm" mode. The electromagnet solenoid magnetically draws armature 6 within the coil of the solenoid, pulling slider 10 to which the armature is connected toward the solenoid against the restraint of spring 14, which expands and is placed in tension. As the slider 10 is drawn to solenoid 7, the barrier portion of the slider is moved out of channel 13, removing the blockage from the channel, such as is illustrated in FIG. 2 to which reference is made. When the slider reaches the uppermost position of travel, the device is ready to "fire".

The circuit through leads 21 and 23 is broken to result in a signal for personnel. In the indicator window in the cover, not illustrated, the green colored patch on the slider moves out of view and is replaced by the red patch 73. The device is thus in the arm mode, ready to be fired. As long as the electromagnet solenoid 7 remains energized, the device remains in the armed condition. Should the solenoid be de-energized, spring 14 pulls slider 10 back to the normal "safe" position. The shear pin 15, another safety precaution, is strong enough to obstruct travel of the firing piston 11 when the latter is motivated only by vibration and/or acceleration, since the piston is thin, light weight, relatively flat and possesses insufficient moment of inertia.

To fire the device, electrical current is next applied to the input terminals of MEMS ignition device 5 via leads 19 and 20. The ignition device produces a "micro-burst" of hot gas and pressure that is directed against firing piston 11. Under the force exerted by the rapidly expanding hot gas and pressure wave, the shear pin 15 breaks and the firing piston 11 is propelled through channel 13 to the left, ultimately striking the side wall, not illustrated, to window 12 in slider 10, covering a portion of window 12, but leaving a portion of that window unobstructed.

The hot gases and pressure wave exit through window 12, perpendicular to the plane of the paper in FIG. 2, through which the gas and pressure may be applied to initiate a larger explosive device, the secondary ignitor, either directly or indirectly. As later herein described the foregoing may be combined with an electrical switch of micro-miniature size to electrically trigger an electrically actuated explosive device, such as illustrated in FIGS. 6 through 10 later herein described.

In a practical example the base 3 of the foregoing embodiment is 2.5 cm by 2.5 cm square and 0.1 cm thick; and the entire unit weights about 2 grams. Compared to the "fist" sized units currently being used, weighing approximately 32 ounces, the arm and fire device of the present invention represents an improvement in weight alone of more than 99.9%, and a volume savings of about 99.99%.

Figure 4:
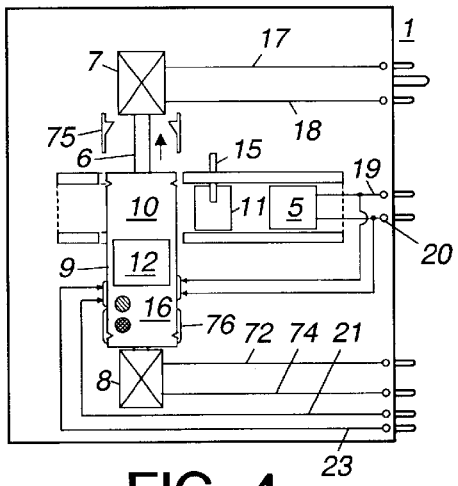
FIG. 4 is an embodiment of a safe and arm device as the embodiment appears in the safe mode.
Figure 5:
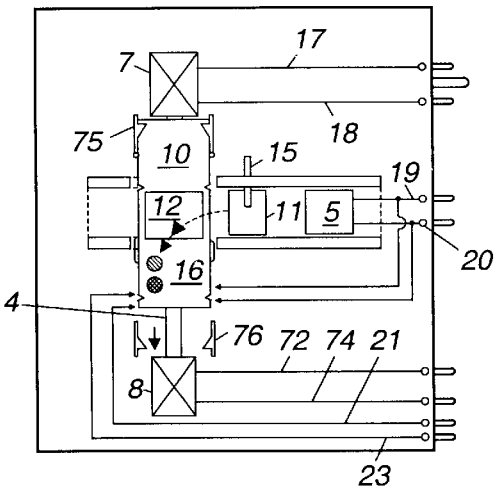
FIG. 5 shows the embodiment of FIG. 4 as the embodiment appears in the arm mode.
Figure 6:
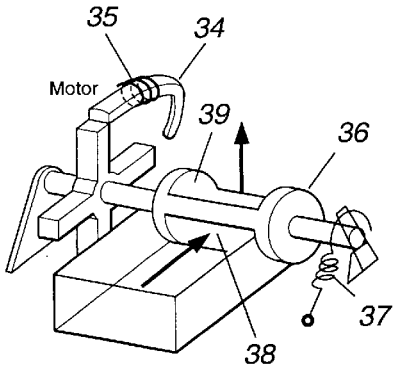
FIG. 6 illustrates a rotary form of the movable barrier that may be substituted for the slidable barrier component in an alternative embodiment of the arm fire device of FIG. 1.

A safe and arm device constructed in accordance with the invention is illustrated in FIGS. 4 and 5 to which reference is made. As recalled, in this kind of device, the device is armed by application of electrical power, and remains armed even when the electrical power is subsequently withdrawn. The device is reset to the safe mode by application of power. As generally observed from the figures, the structure of the safe and arm device employs many of the same components that are included in the arm fire device of FIG. 1. To avoid unnecessary repetition and to facilitate understanding of the embodiment, the elements of this embodiment are given the same denomination as the corresponding element of the prior embodiment. Only those components added or the modifications to those components are given a new denomination.

A second electromagnet solenoid 8 is included in the embodiment of FIG. 4, in lieu of the tension spring 14 used in FIG. 1. Leads 72 and 74 are included on base 3 to connect current to the solenoid 8, when the solenoid is to be operated. A pair of spring clip formed latches are mounted to the base, one on each side of the path of movement of slider 10 and at the bottom end of the slider, respectively. The upper and lower ends of slider 10 are notched on each side to form the catches for the releasable latches. The latches are designed to release their grip on the slider, when the solenoid exerts a linear pull on the slider. The latches should hold the slider against foreseeable shock and vibration.

As in the prior embodiment in the "safe" condition illustrated, should MEMS ignition device 5 inadvertently fire, the hot expanding gases and the pressure wave will be sufficient to force firing piston 11 to the left and break shear pin 15, which otherwise holds that piston stationary. However the piston strikes the side of slider 10 and cannot move any further to the left. When current is applied to electromagnet solenoid 7 (via leads 17 and 18), the solenoid pulls in the armature 6, and, thereby releases latch 76, and pulls the slider assembly close, the uppermost position of travel, as shown in FIG. 5 to which reference 25 is made.

The window 12 in slider 10 is moved into place in firing channel 13, removing the barrier from the channel. As in the prior embodiment, the device is ready to fire. When moved to electromagnet solenoid 7, the spring clips 75 engage the notches in the side of the upper end of slider 10 to latch the slider in place. Should the power to the electromagnet solenoid 7 be removed, the latches prevent the slider from moving. Hence, the slider remains in the armed position illustrated, ready to fire.

As in the prior embodiment, when the device is in safe mode, an indicator circuit is closed through leads 21 and 23, the contacts abutting the side of piston 16 and the conductive bridging contact on the side of the piston and the green patch 71 is visible through the indicator window in the cover.

The firing of the device is the same as in the prior embodiment, and need not be repeated. If one wishes to halt the arm condition of the device and return to the safe mode, then current is applied to electromagnet solenoid 8. The electromagnet produces a magnetic field that pulls the solenoid armature 4 into the solenoid. Since armature 4 is attached to the lower end of slider 10, the slider is pulled back to the normal position illustrated in FIG. 4. The force produced by the solenoid is sufficient to overcome the restraining force of the latches 75. The spring clips of the latch are forced out of the notches as the slider is pulled toward electromagnet 8. On completion, the device is restored to the position shown in FIG. 4, and the indicator circuit and the mechanical indicator both indicate "safe".

The foregoing embodiment of FIG. 1 employed a slide type of arming device. The function served by slider assembly 9 may alternatively be served by a rotary type device, such as the device pictorially illustrated in FIG. 6 to which references is made. In this a motor mechanism 34, containing electromagnetic coil 35, turns the shaft of a cylindrical valve 36 by ninety degrees against the restraint of a spring when electromagnet coil 35 is energized with DC current. The side of the cylinder contains two openings 38 and 39 that are spaced ninety degrees apart about the cylindrical axis. The cylinder also contains an internal passage between those openings. In application, when the motor winding is energized the shaft turns by ninety degrees, to orient the two passages one way. When the winding is deenergized, the magnetic pull of the winding collapses, and spring 37 turns the shaft in the reverse directing reorienting the passages in cylinder 36 to the normal position. As placed into the device, as example, of FIG. 1, the orientation in the normal position normally prevents gas from passing through the cylinder when the motor winding is not energized.

In such application, the side of cylinder 36 is positioned against the end wall of a passage, such as passage 13 in FIG. 1, whose end edges are for this adaptation shaped to the diameter of the cylinder so as to mate with the right and left hand cylindrical surfaces of the cylinder. Normally, when motor winding 35 is not energized, passage 39 faces into the firing channel 13, but the connected passage 38 faces the bottom of the mounting 3, thereby blocking the escape of any pressurized gas, should the gas generator 5 inadvertently fire. When the motor winding 35 is energized, the shaft turns by ninety degrees, orienting passage 39 upwardly, and passage 38 into passage 13. If the MEMS ignition device 5 is fired, the pyrotechnic output travels through passage 13 as earlier described in connection with the operation of FIG. 1, then through the cylinder and out passage 39. If the power extinguishes before firing the ignition device, the spring restores the cylinder to the blocking orientation, the "safe" position. As one appreciates in this embodiment and in all of the other embodiments, the side walls of the passages, such as passage 13 must be of a material and/or thickness and strength that is sufficient to withstand the force of the anticipated pyrotechnic output without falling apart or distorting in shape.

Figure 7:
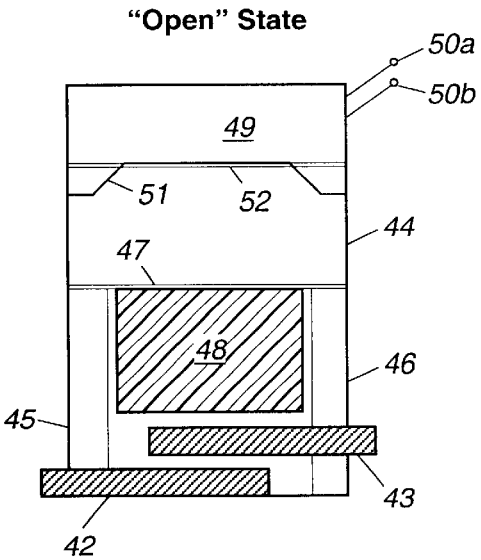
FIGS. 7 and 8 illustrate an embodiment of a single operation digital gas motivated electrical switch in respective standby and operated modes.
Figure 8:
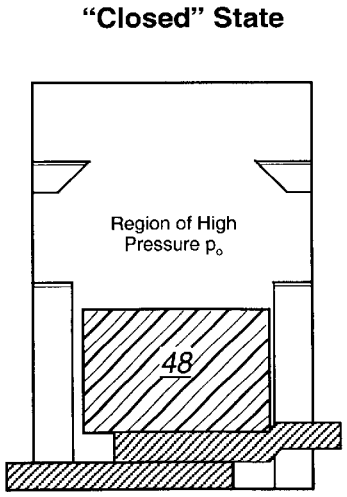

Reference is made to FIGS. 7 and 8 which illustrate an alternative MEMS single operation electrical operated MEMS gas generator motivated electrical switch prior to and following operation. The switch includes a pair of electrical leads or conductive metal contacts 42 and 43, elongate in geometry, positioned at the lower end of a rectangular shaped housing 44. A pair of relatively thick interior sidewalls or supports 45 and 46 are affixed to opposite walls of the housing. Both the housing walls and the sidewalls supports 45 and 46 are formed of electrically non-conductive material, such as Silicon. Contact 42 lies on the bottom of the housing extending over a considerable portion of the bottom surface. The contact further extends through support 45 and the adjacent wall to the housing exterior so that the contact may be accessed by external circuitry.

Contact 43 is held in a cantilever fashion by support wall 46 in a position overlying contact 42 and extends parallel to the latter contact. Contact 43 is sufficient in length to extend over a major portion of that portion of contact 42 that is located interior of housing 44; and also extends through the wall to the housing exterior. Metal contacts 42 and 43 define a normally open electrical circuit through the switch housing. Contact 43 is sufficiently rigid to maintain sufficient clearance to the adjacent contact in the presence of any foreseeable shock and vibration.

A bar membrane 47 extends across the housing interior, supported by the upper ends of sidewalls 45 and 46 to which the bar is affixed. A rectangular block of non-conductive material 48, suitably of silicon, is supported in between side walls 45 and 46 from the underside of bar membrane 47, leaving a slight clearance on each of the right and left hand sides of the block, suitably less than one micron in clearance. Block 48, sometimes referred to as the "silicon hammer", overlies and is spaced from contact 43. The upper end of housing 44 contains the MEMS gas generator 49, pictorially illustrated, that was earlier described. Electrical power for initiating the generator 49 is supplied via electrical leads 50*a* and 50*b*. A small ledge 51, only portions of which are illustrated, extends about the upper walls of housing 44 and serves to support a covering membrane 52, that divides the internal region above, containing gas generator 49, from that below. Together with bar membrane 47, covering membrane 52 defines a plenum for gas. Both membranes 47 and 52 are rupturable.

When the switch is to be operated, a short pulse of current is applied via leads 50*a* and 50*b* to the MEMS gas generator, which, in response, explodes the confined pyrotechnic material, producing a burst of hot expanding gas. The force produced by the gas is released against membrane 51, which ruptures, and further expands into the plenum region, applying the force of the gas against the membrane bar 47. The membrane bar and the silicon hammer 48 are driven down by the force, rupturing membrane bar 47 and driving silicon hammer 48 into contact 43. As illustrated in FIG. 8, silicon hammer presses against contact 43 and being fragile the contact deforms and/or bends and presses against contact 42, closing an electrical circuit through the switch.

In a practical example, in overall dimension the switch of FIG. 7 may be one millimeter square, membrane 52 may be one mm in thickness and be of any appropriate material, such as a metal foil. Membrane bar 47 man be about one-half micron in thickness and comprise a more thick metal foil. Side walls 45 and 46 may be about 100 microns thick and be formed of silicon. The housing may comprise any insulator material. Using conventional techniques the cantilever contact 43 is formed of silicon. An electrode, a conductive load pad is manufactured and positioned under the cantilever contact. When the switch is fired, the pressure of the pyrotechnic blast breaks the plenums and drives the hammer. In turn the hammer impacts the cantilever contact, forcing the cantilever into contact with the electrode 42, thereby closing the switch.

Electrical switches may be of a mechanical design different from that of FIGS. 7 and 8, all of which make use of the MEMS digital propulsion gas generator to operate the switch. Several of those alternative designs are illustrated in FIGS. 9, 10, 11 and 12.

Figure 9:
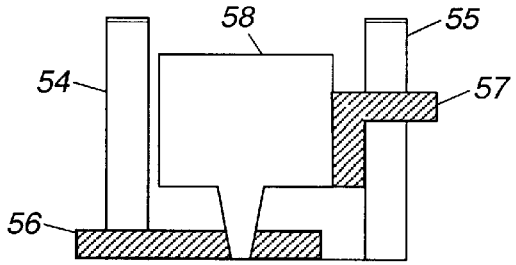
FIG. 9 partially illustrates an alternative embodiment of a single operation digital gas motivated electrical switch.

The switch of FIG. 9 includes the pair of relatively thick side walls 54 and 55, as in the preceding embodiment, a pair of electrical contacts 56 and 57, and a movable block 58, the hammer. In this embodiment hammer 58 is of electrically conductive material or has electrically conductive sides so that the hammer may also serve as a bridging contact between contacts 56 and 57. The switch contains the same upper section, not illustrated, as in the switch of FIG. 7. When the MEMS device operates and creates the force to rupture the membranes and drive the hammer 58 down, the side of the hammer brushes against wiper contact 57 and the front moves into contact with contact 56, such as illustrated in the operated mode, in the figure. The electrical circuit completes through the conductive sides of the hammer 58. In this embodiment, as an improvement, the face of the hammer includes a projection in the shape of a truncated right cone, and the contact 56 includes a conical shaped passage that is aligned with the cone. The conical passage provides a mechanical device that allows for slight misalignment between the conductive cone of the hammer and the axis of the passage, providing for self-alignment. Additionally since the cone may scrape against the conical walls when the hammer 58 is descending and essentially clean the contact of any dirt resulting in a more reliable electrical contact as compared to a contact that simply is pressed against the contact surface.

Figure 10:
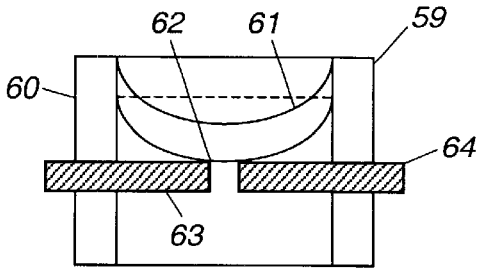
FIG. 10 partially illustrates a further alternative embodiment of a single operation digital gas motivated electrical switch.

In the switch embodiment partially illustrated in FIG. 10, an electrically conductive metal diaphragm, 62 resembling a coffee can or oil can lid is used to provide a bridging contact for the spaced contacts 63 and 64. A second metal diaphragm 61 is mounted in overlying relationship, leaving a gas chamber there between. Both diaphragms are attached about the peripheral edge to the walls 59 and 60, at respective vertical locations along the wall. In the switch, contacts 63 are mounted through passages in insulating walls 59 and 60 with ends of the two contacts facing one another across an air gap. The membrane 62 normally bulges in one direction, the upward direction, as example. When a force applied to that membrane in the opposite direction attains a sufficient level, the membrane inverts, and bulges in the opposite direction. In the switch, force is applied by the expanding gas released by the MEMS thruster, not illustrated, against diaphragm 61 and forces the diaphragm downward, compressing the gas in the confined region. In turn that compressed gas creates a force on diaphragm 62, which rises to a sufficient level to invert diaphragm 62. By design, the downward bulge is great enough to permit the metal diaphragm to contact both contacts 63 and 64 bridging a circuit between the contacts.

Figure 11:
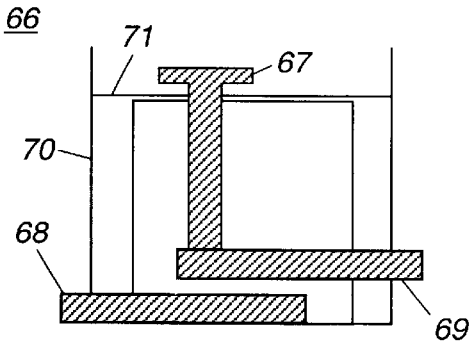
FIGS. 11 and 12 illustrate a still further alternative embodiment of a single operation digital gas motivated electrical switch in normal and operated positions, respectively.
Figure 12:
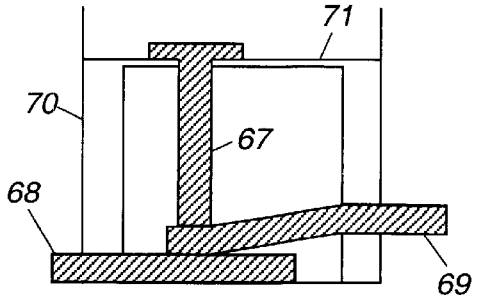

Another micro-miniature switch structure is partially illustrated in FIGS. 11 and 12 in normal and operated positions, respectively. As with the prior switch embodiments the MEMS gas generator is omitted from the illustration. In this embodiment the switch operator is a plunger 67. Electrical terminals 68 and 69 serve as the switch contacts. Each electrical terminal is an elongate strip of conductive metal, attached to housing 70. Each strip extends from the exterior of the housing, through the housing wall and through a portion of the housing interior with electric terminal strip 69 overlying and parallel to a portion of electric terminal strip 68 disposed on the bottom of the housing. Housing 70 includes two side walls and a top wall 71, the latter containing a passage for the shaft of plunger 67.

The plunger includes a wide diameter head, greater in diameter than the shaft; and the head is located within the upper housing region that receives the micro-blast of gas from the micro-thruster, not illustrated. The plunger may be formed of a light weight rigid metal or plastic material. On assembly, the shaft of plunger 67 is inserted through the passage and the end of the shaft abuts the upper surface of contact 69. The rigidity of the contact strip 69 should be sufficient to permit the contact to bear the weight of the plunger without significant deflection, maintaining clearance with the other contact strip 68. The shaft of the plunger is of sufficient length to permit the head of the plunger to be slightly elevated above the upper surface of wall 71 when the end of the shaft is supported on contact strip 69. This is the normal position of plunger 67. When the switch is operated, the plunger is moved down to the second position with the head abutting the upper surface of wall 71, as later herein described in connection with FIG. 12.

As in the switches earlier described, when the switch is to be operated to close a DC circuit between contacts 68 and 69, a pulse of current is applied to the input of the micro-thruster, not illustrated, of the switch. The current pulse heats the resistance material of the igniter, and ignites the pyrotechnic material in the housing of the micro-thruster, in the manner earlier herein described. The micro-thruster produces a micro-blast of hot expanding gas accompanied by a spiked rise in pressure. That gas and pressure impulse is directed into the chamber above wall 71, and, hence, against the head of plunger 67.

As shown in FIG. 12, the plunger is thereby driven downward until the head abuts the wall 71. In moving down, the shaft of the plunger presses against and bends the cantilevered end of contact 69 into contact with contact 68, which completes a DC circuit through the switch. Contact 69 may be constructed to be deformable in character, in which event the switch remains closed even after termination of the micro-blast. The contact may alternatively be flexible in character, such as spring copper alloy, so as to restore to the first position when the micro-blast extinguishes.

It is appreciated that the foregoing electric switch structures are of the normally open variety. That is, the switch contacts are normally separated to interrupt a DC current path through the contacts of the switch, and, when the switch is operated, the contacts are in abutment closing a DC current path there through. The foregoing mode of switch operation is consistent with present requirements for electrically detonated explosive devices that require the application of a current to ignite the device. However, in alternative embodiments some designers may chose to require the interruption or opening of a normally closed DC circuit to signify the onset of an electrically initiated explosive train. In that case the foregoing switch structures of FIGS. 7–12 should be modified so that the switch contacts are normally in electrical contact, and separate to break the DC circuit with the switch is operated.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification.

Thus, the invention is to be broadly construed within the full scope of the appended claims.

What is claimed is:

1. A miniature arming device having an armed state and an unarmed state, comprising:

a MEMS ignition device for producing a pyrotechnic output at a first location in response to application of an electric signal;

pyrotechnic output control means, having an armed state and an unarmed state, for routing said pyrotechnic output from said first location to a second location when in said armed state and blocking said pyrotechnic output from said second location when in said unarmed state;

a substrate, said substrate supporting said MEMS ignition device and said control means;

and wherein said pyrotechnic output control means comprises:

a channel for communicating a pyrotechnic output, said channel having an input and an output;

a pyrotechnic barrier, said pyrotechnic barrier normally blocking said channel; and an electromagnet for moving said pyrotechnic barrier to unblock said channel when said electromagnet is energized, wherein a pyrotechnic output may pass through said channel to said second location.

2. The arming device of claim 1, wherein said pyrotechnic output control means further comprises:

restoring means for restoring said pyrotechnic barrier to a position blocking said channel when said electromagnet is de-energized.

3. The arming device of claim 2, wherein said restoring means comprises a spring.

4. The arming device of claim 2, wherein said restoring means comprises a second electromagnet, said second electromagnet moving said pyrotechnic barrier to a blocking position in said channel responsive to energization of said second electromagnet.

5. The arming device of claim 1, further comprising: a pressure operated electrical switch, said pressure operated electrical switch being positioned to receive pressure from said output of said channel.

6. The arming device of claim 2, wherein said pyrotechnic barrier includes:

a slider assembly, said slider assembly extending through said channel in a direction transverse to the axis of said channel;

said slider assembly including a first portion, a window and a second portion, said window being located between said first and second portion, and said first portion being of a size to block said channel;

said slider assembly being normally positioned with said first portion in said channel to block said channel;

said electromagnet being coupled to said slider assembly for moving said first portion out of said channel and said window portion into said channel to open a channel output when said electromagnet is energized.

7. The arming device of claim 6, further comprising a spring for restoring said slider assembly to the normal position when said electromagnet is deenergized.

8. The arming device of claim 7, wherein said electromagnet comprises a solenoid, said solenoid including a movable core; and wherein said movable core is coupled to said slider assembly.

9. The arming device of claim 8, wherein each of said first and second portion of said slider assembly comprises a magnetic material.

10. The arming device of claim 8, wherein said pyrotechnic output control means further includes:

a block;

a shear pin;

said block being disposed within said channel adjacent said input to said channel to block said channel; and said shear pin connected to said channel and said block for holding said block in a predetermined position in said channel in the absence of a pyrotechnic output from said MEMS ignition device.

11. The arming device as defined in claim 3, further comprising:

a fusible link;

said fusible link for restraining expansion of said spring until said spring is fused, whereby said pyrotechnic barrier is restrained from moving due to shock and vibration during transportation; and electrical lead means for coupling a source of electrical current through said fusible link when desired to fuse said fusible link.

12. The arming device of claim 2, further comprising:

a releasible latch for holding said pyrotechnic barrier in said unblocking position following de-energization of said electromagnet, whereby said arming device remains in an armed state;

a restoring electromagnet;

said restoring electromagnet for releasing said latch and moving said pyrotechnic barrier into a position blocking said channel.

13. The arming device as defined in claim 12, further comprising: indicator means for indicating whether said pyrotechnic output control means is in an armed state or an unarmed state.

14. A miniature arming device having an armed state and an unarmed state, comprising:

a MEMS ignition device for producing a pyrotechnic output at a first location in response to application of an electric signal;

pyrotechnic output control means, having an armed state and an unarmed state, for routing said pyrotechnic output from said first location to a second location when in said armed slate and blocking said pyrotechnic output from said second location when in said unarmed state;

a substrate, said substrate supporting said MEMS ignition device and said control means;

and wherein said pyrotechnic output control means further includes means for shunting electrical signals from said MEMS ignition device when said pyrotechnic output control means is in said unarmed state.

15. The arming device as defined in claim 1, wherein said electromagnet further comprises a solenoid, said solenoid including an armature.

* * * * *